US005667247A

United States Patent [19]

Ramsburg et al.

[11] Patent Number: 5,667,247

[45] Date of Patent: Sep. 16, 1997

[54] TELEPHONE DEBIT CARD PRODUCTION

[75] Inventors: E. Douglas Ramsburg, Thurmont, Md.; Stephen R. Nassoiy, Vienna, Va.; Dennis V. Zutant, Rockville, Md.

[73] Assignee: Moore Business Formsk Inc., Grand Island, N.Y.

[21] Appl. No.: 469,927

[22] Filed: Jun. 6, 1995

[51] Int. Cl.[6] ..... B42D 15/00

[52] U.S. Cl. ..... 283/61; 283/904; 462/6; 229/71

[58] Field of Search ..... 283/101, 75, 904, 283/116, 61; 229/71, 303; 462/6; 428/42.1, 43

[56] References Cited

U.S. PATENT DOCUMENTS

| | | | |
|---|---|---|---|
| 1,601,318 | 9/1926 | Overly | 229/71 |
| 1,995,778 | 3/1935 | Overly | 229/71 |
| 2,936,946 | 5/1960 | Harpman | 229/303 |
| 2,985,464 | 5/1961 | McFarland | 229/71 X |
| 3,136,476 | 6/1964 | Berkowitz | 229/71 |
| 3,288,350 | 11/1966 | Kushner | 229/70 |
| 3,365,117 | 1/1968 | Powell, Jr. | 229/71 |
| 3,658,239 | 4/1972 | Foultz | 229/303 X |
| 3,726,471 | 4/1973 | Kalb | 229/70 X |
| 3,838,808 | 10/1974 | Schroeder | 229/71 X |
| 4,917,287 | 4/1990 | Watson | 229/303 X |
| 5,427,832 | 6/1995 | Longtin | 283/101 X |

*Primary Examiner*—Frances Han
*Attorney, Agent, or Firm*—Nixon & Vanderhye P.C.

[57] ABSTRACT

A card package assembly, and method of production, are particularly suited for use with telephone debit cards. A package is formed by folding a sheet of paper into three panels, one of which has a cutout with adhesive adjacent it. The card is held to the paper covering the cutout with identifying indicia on the card visible through the cutout from the bottom during processing, to allow verification. A tracking strip that may be readily detached from the package without opening it has tracking indicia and transfer tape on the back so that when the release sheet portion of the transfer tape is removed, adhesive is exposed which allows the tracking strip to be connected to any desired surface. The package also includes an opening-facilitating strip which is preferably reinforced, also preferably with a strip of transfer tape. The card within the package is not visible from its exterior, although a substantially actual size replica of the first face of the card may be printed on a sheet portion which will form the exterior of the package.

20 Claims, 4 Drawing Sheets

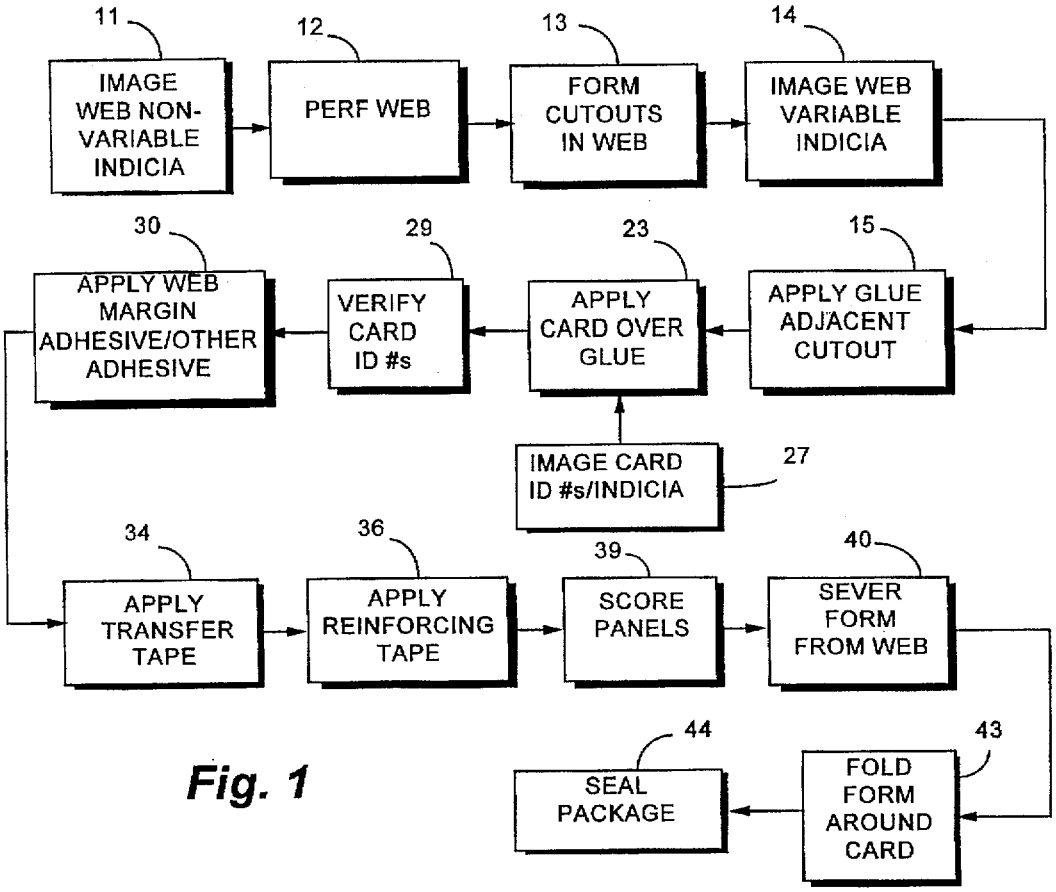
Fig. 1
Fig. 2
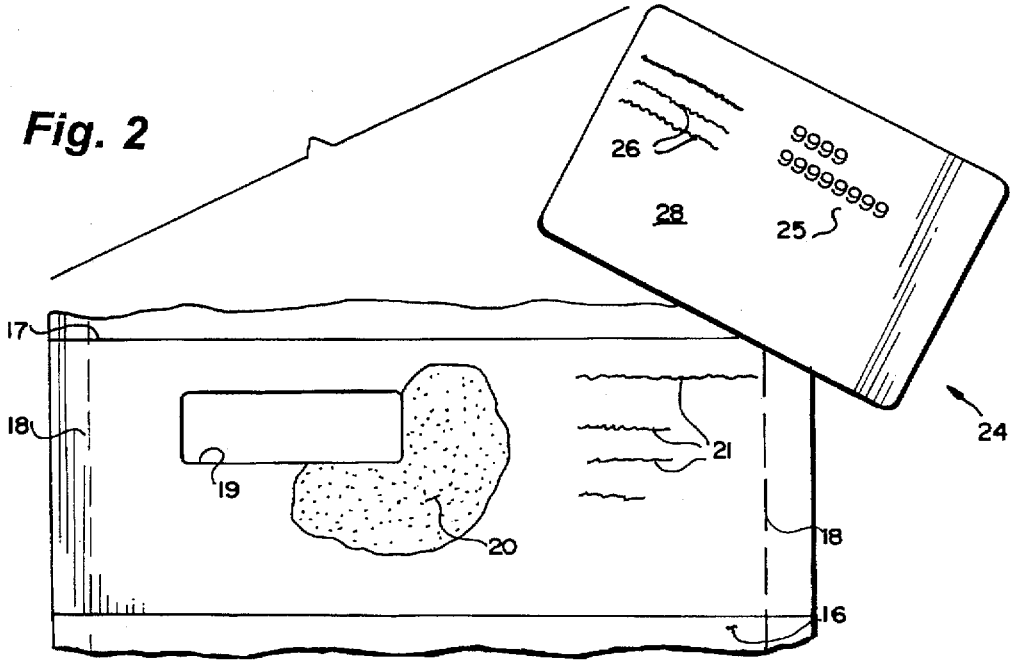

Fig. 5
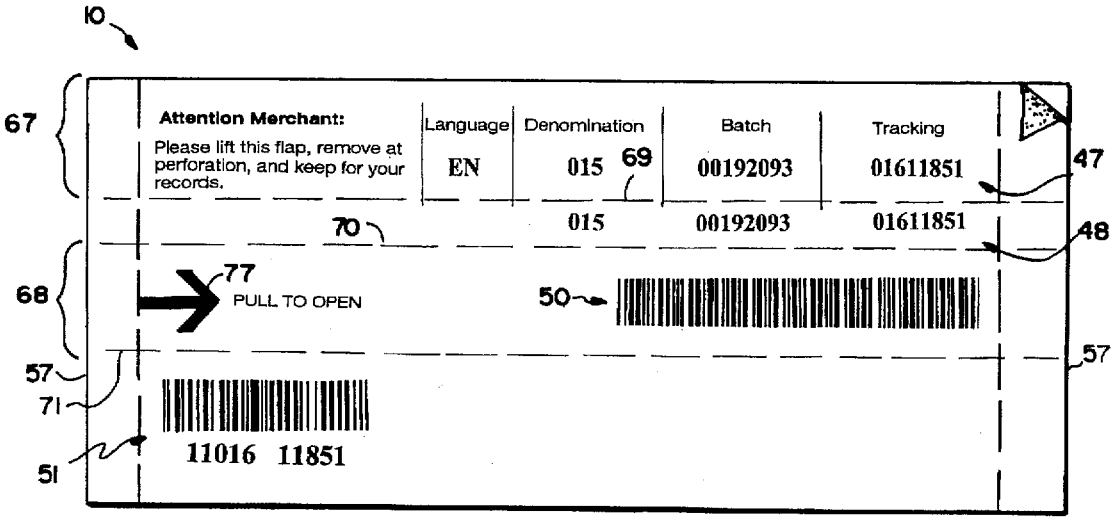
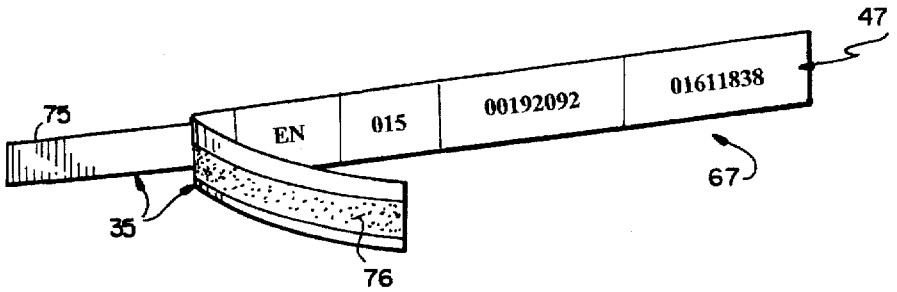
Fig. 6

TELEPHONE DEBIT CARD PRODUCTION

BACKGROUND AND SUMMARY OF THE INVENTION

With the utilization and production of a large number of different types of cards for many uses, such as credit cards, debit cards, identification cards, and the like, different manners of effectively, securely, and aesthetically delivering the cards to ultimate consumers need to be utilized. In copending application Ser. No. 08/155,759, filed Nov. 23, 1993, a method of making a card carrier, and a card carrier package, are provided that allow the efficient transport of a card while protecting confidential information thereon, but allowing a viewer to determine from the exterior of the card what is contained in the package. While the package provided in said copending application is very effective, there are some times when different criteria apply which require different types of secure features, or require tracking of the packages. For example, in the production and delivery of telephone debit cards (which allow a user to purchase a card for a certain number of units (e.g. long distance minutes) and call an 800 number which allows connection to any other desired telephone until those minutes have been used up) it is necessary to be able to effectively track the cards, and to completely and securely package the cards so that no confidential information on the cards is visible from the exterior of the package, yet during manufacture the correctness of the card in a particular package has been verified. Also, in those circumstances it is often desirable that the purchaser be able to see what the card that is being purchased looks like without opening the package.

According to the present invention a card package assembly (and a method of production thereof) are provided which allow all of the above desired objectives to be achieved, yet the card package is extremely simple and versatile. A card package according to the invention while providing effective tracking does not necessitate that the user open the package in order to facilitate tracking; rather a tracking strip may be removed (and adhesively affixed to another surface, such as a log book or sheet) without the necessity of opening up the package, yet opening of the package is simple, easy, and almost fail safe. The package allows verification after the card has been connected to components of the package during manufacturing, yet completely encloses the card so that no confidential aspect thereof is at all visible from the exterior. The packages according to the present invention may be sold in retail establishments, sent in the mail, or otherwise readily delivered to ultimate consumer.

According to one aspect of the present invention a card package assembly is provided comprising the following components: A sheet of material having first and second side edges, first, second and third panels, the second panel immediately adjacent the first panel and the second panel at least as large as the first panel, and having first and second faces. The first panel having a cutout therein. Card-holding adhesive on the first panel second face adjacent the cutout. A card of material stiffer than the sheet of material, and having first and second faces, with identifying indicia on the second face. The card overlying the cutout and connected to the card-holding adhesive so that the identifying indicia is visible through the cutout. And adhesive patterns disposed adjacent the first and second side edges for holding the first second and third panels together with the second panel covering the card first face, and the third panel covering the cutout.

The sheet (typically paper, such as that used for the production of colored magazines) typically has third and fourth edges perpendicular to the first and second edges, the third edge defining part of the third panel. The third panel includes a line of weakness parallel to and spaced from the third edge to define a tracking flap in the third panel. Tracking indicia is imaged on the tracking flap first face, and transfer tape is disposed on a second face of the tracking flap so that when the release portion of the transfer tape is removed adhesive is exposed which allows attachment of the tracking flap to another object, such as a logbook page. Typically a transverse adhesive pattern is provided adjacent the first line of weakness on the third panel second face, connecting the third panel second face to the second panel first face removed from the cutout. A second line of weakness is provided in the third panel parallel to the first line of weakness and on the opposite side of the transverse adhesive pattern from the first line of weakness, and a third line of weakness is also provided in the third panel parallel to the second line of weakness and on the opposite side thereof from the transverse adhesive pattern. The second and third lines of weakness form an opening-facilitating (tear) strip between them, and a piece of reinforcing material is provided on the second face of the third panel at the opening-facilitating strip to reinforce it. Preferably the reinforcing material is a second piece of transfer tape; although typically the adhesive on the second piece of transfer tape is not used to connect the opening-facilitating strip to any other object, of course it can be utilized to so connect the opening-facilitating strip, especially if bar coding or other machine readable indicia is imaged on the first face thereof.

It is particularly desirable to provide a card package assembly according to the invention in which the card is a telephone debit card. In this circumstance the debit card will have a predetermined value, such as a 50 units (minutes) of long distance time anywhere in the continental U.S. In this situation the indicia on the second panel first face preferably comprises a simulation of the first face of the card, including the value (e.g. 50 units) of the card within the package.

According to another aspect of the present invention a card package assembly is provided comprising the following elements: A sheet of material having first and second side edges, third and fourth transverse edges perpendicular to the side edges, first, second and third panels, the second panel immediately adjacent the first panel and the second panel at least as large as the first panel, the third edge defining part of the third panel; and the sheet having first and second faces. A card of material stiffer than the sheet of material, and having first and second faces, with identifying indicia on at least the second face. The card operatively connected to one of the panels. Longitudinal adhesive patterns disposed adjacent the first and second side edges for holding the first second and third panels together with the panels covering the card first and second faces wherein the third panel includes a first line of weakness parallel to and spaced from the third edge to define a tracking flap in the third panel. And tracking indicia imaged on the tracking flap first face. The details of the card package are preferably as described above.

According to yet another aspect of the present invention a method of producing a card package, utilizing a web of sheet material (e.g. paper) and cards of stiffer material (e.g. plastic or increased thickness paper) than the web, each of the web and card having first and second faces and the web detachable to form individual sheets. The method comprises the following steps: (a) Imaging identifying indicia on at least the second face of the card and the first face of the web. (b) Forming cutouts in the web, at least a first cutout in each sheet to be formed from the web. (c) Applying glue to the second face of the web adjacent each first cutout. (d) Merging the cards with the web so that a card covers each first cutout and is connected to the web second face by the glue adjacent each first cutout, and so that identifying indicia on the card second face is visible through the first cutout. (e) Verifying the appropriateness of each card covering a first cutout by machine-reading the identifying indicia on the card second face through each first cutout. (f) Applying adhesive to the web that will hold each sheet in a package configuration when folded. (g) Severing each sheet, with at least one card thereon, from the web. And (h) folding each sheet into a package configuration having at least three panels, the card first and second faces being covered by panels of the sheet and held together in that configuration by the adhesive applied in step (f).

Each sheet has a transverse free edge, and step (a) is typically practiced to image tracking image indicia on the web which will be on the first face of each sheet adjacent the transverse free edge. There then typically the further steps of forming a first line of weakness in the web which will be adjacent the tracking indicia, on the opposite side thereof from the transverse free edge, to define a tracking flap containing the tracking indicia; and applying a piece of transfer tape to the web second face which will become the second face of the tracking flap.

Step (f) is typically practiced, at least in part, to provide a transverse pattern of adhesive on the web second face on what will be adjacent the tracking flap on the opposite side thereof from the transverse free edge. There are also preferably the further steps of forming second and third lines of weakness in the web for what will become each sheet, the second and third lines of weakness parallel to the first line of weakness and on the opposite side thereof from the transverse pattern of adhesive, and defining a package opening-facilitating strip. The method also typically comprises the still further step of applying a second piece of transfer tape to the second face of the web on what will become a package opening-facilitating strip, the second piece of transfer tape acting as a reinforcing strip.

Accordingly it is the primary object of the present invention to provide an efficient, simple, versatile, and effective package assembly (and method of production thereof) for cards which provide confidentiality, ease of handling and transport, the ability to track and/or the like. This and other objects of the invention will become clear from an inspection of a detailed description of the invention, and from the appended claims.

BRIEF DESCRIPTION OF THE DRAWINGS

FIG. 1 is a schematic box diagram showing various method steps that may be formed according to the invention;

FIG. 2 is a top plan view of a part of a web used to manufacture card packages according to the invention showing a cutout and glue at a portion of the web, and the second face of a card adapted to be brought into contact therewith;

FIG. 5 is a top plan view of the tracking flap and opening-facilitating strip face of a formed package assembly according to the invention; and FIG. 6 is a perspective of a tracking flap after removal from the package of FIG. 5, and bent over to show the exposed adhesive on the second face thereof.

DETAILED DESCRIPTION OF THE DRAWINGS

Figure 3:
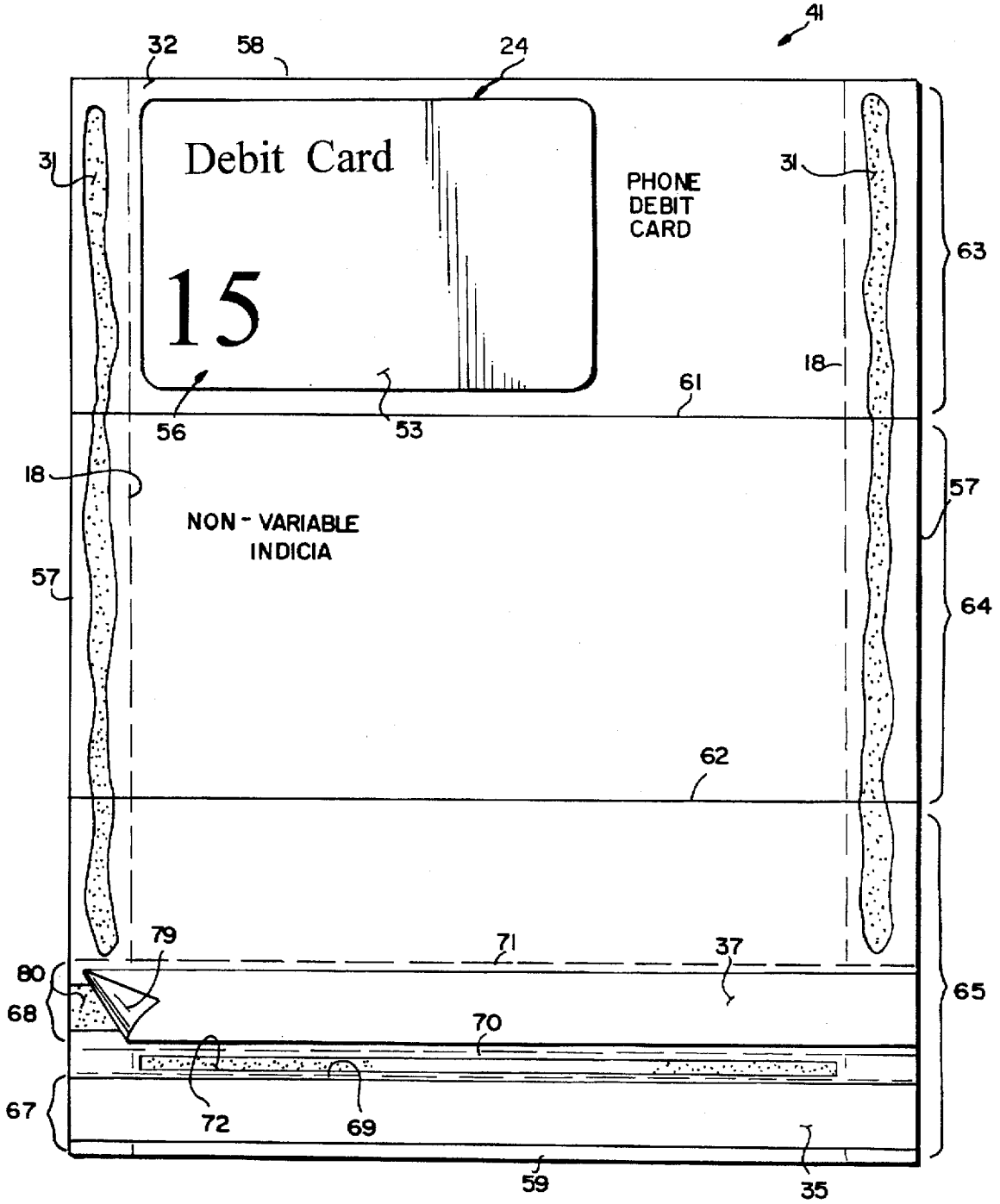
FIG. 3 is a top plan view of a bottom face of a package according to the present invention, with card attached, prior to folding into the final package assembly.

FIG. 1 schematically illustrates an exemplary manner of production of a card containing package according to the present invention. The ultimate card containing package produced is shown generally by reference numeral 10 in FIG. 5. While FIG. 1 shows various steps in a particular sequence, it is to be understood that the sequence can be varied widely; a number of different steps can be practiced before and after others.

The first step illustrated in FIG. 1, at box 11, is the imaging of a web of paper or like sheet material with non-variable indicia, as by utilizing a conventional printing press. The web is typically perfed as indicated at 12 (or has other lines of weakness formed therein), either longitudinal to the direction of movement or both longitudinal or transverse in the same step. Different types of perfing can be done in different stages. Also, a stage 13 is provided in which cutouts are formed in the web, at least a first cutout for each sheet of material to be separated from the web for ultimate production of the package 10. Also, variable indicia is imaged on the web as indicated at 14, the variable indicia including things such as identifying numbers to facilitate tracking of the card so that a retailer must call in if the card has been sold before the card can be utilized (as a security measure).

Box 15 indicates a step of applying glue adjacent the cutout formed in the web. FIG. 2 shows a web 16 during production, which has already had the perfs 17 separating one sheet from one another ultimately, and side perfs 18, formed therein, as well as a cutout 19. FIG. 2 schematically illustrates the application of cold glue 20 of the type that will stick to a card, yet allow release of the card without the glue being retained on the card, adjacent the cutout 19. It is desired that the glue 20 be formed along at least two edges of the cutout 19—as illustrated in FIG. 2—although it can be located elsewhere depending upon the size of the cutout 19, the size of the card, and the size of the identifying indicia on the card to be verified. FIG. 2 also shows non-variable indicia—schematically at 21—which is then imaged in stage 11.

After stage 15 the card is applied over the glue, as indicated by box 23. FIG. 2 shows an exemplary card 24 having identifying indicia (e.g. numbers) 25 thereof which need verification, as well as other indicia 26, such as non-variable indicia. The card 24 illustrated in FIG. 2 is typically a plastic card of the same size as conventional credit cards or debit cards, but alternatively it may be a paper card (such as shown in copending application Ser. No. 08/155,759) or other materials just so it is at least somewhat stiffer than the web 16 material. The card 24 has been printed with the indicia 25, 26—as indicated by box 27 on FIG. 1—before the card is applied over the glue 20 in stage 23. The card may be applied by tipping on, blowing on, or other conventional techniques.

After the card 24 has been applied to the web 16, with the second face 28 (see FIG. 2) of the card held by the adhesive 20, the identifying numbers 25 (see FIG. 4) are visible through the cutout 19. These indicia 25 are verified by a machine—typically by a camera which looks up from beneath the web 16 to view the indicia 25. Assuming that the indicia are properly verified, the web will continue until ultimate completion of the package. If verification indicates an improper card, the package which ultimately will be severed from the web 16 containing that card will be marked and disposed of further down in the processing. The card verification stage is indicated by reference numeral 29 in FIG. 1.

FIG. 1 also shows a box 30 in which marginal adhesive patterns (e.g. strips or interrupted strips) are applied to the web, as well as other adhesive patterns, such as transverse adhesive patterns. FIG. 3 illustrates marginal adhesive patterns 31 which have been applied, the adhesive 31 typically being pressure sensitive adhesive although rewettable or other types of adhesive may be utilized, and in this case the adhesive 31 is applied to a second face 32 of a sheet/form forming the package 10 which is ultimately severed from the web 16 (e.g. along lines of weakness 17).

Box 34 schematically illustrates the application of transfer tape to the second face 32, as illustrated by the piece of transfer tape 35 in FIG. 3. Also, reinforcing tape is typically applied, as indicated by box 36, exemplary reinforcing tape 37 (which preferably also is a piece of transfer tape) being illustrated in FIG. 3.

If desired, to facilitate folding, score lines, or lines of weakness, such as perforation lines, die cut lines, or the like, may be provided in the web 16 to form panels, as illustrated schematically at 39 in FIG. 1. Ultimately, the web is severed (e.g. along the lines of weakness) to form the forms or sheets which will individually be formed in package 10, as indicated by box 40 in FIG. 1. Such severing action may be by a burster if the lines 17 are lines of weakness, or by cutting. Eventually the individual forms—shown generally by reference numeral 41 in FIGS. 3 and 4—will be folded about the score lines or other interruptions between individual panels thereof, as illustrated schematically at 43 in FIG. 1, and this may simultaneously seal the package 10, or the folded package can go through a separate sealing machine or stage as indicated schematically at 44 in FIG. 1, such as sets of rollers for activating the pressure sensitive cohesive, which may—for example—be of the type available from Topan Moore.

All of the steps illustrated schematically in FIG. 1 may be performed by conventional equipment, there being no necessity for special equipment or adaptations in order to produce the sealed package 10 according to the invention.

The details of the sheet 41 used to form the package 10, and the package 10, will now be described primarily with respect to FIGS. 3 through 6.

Figure 4:
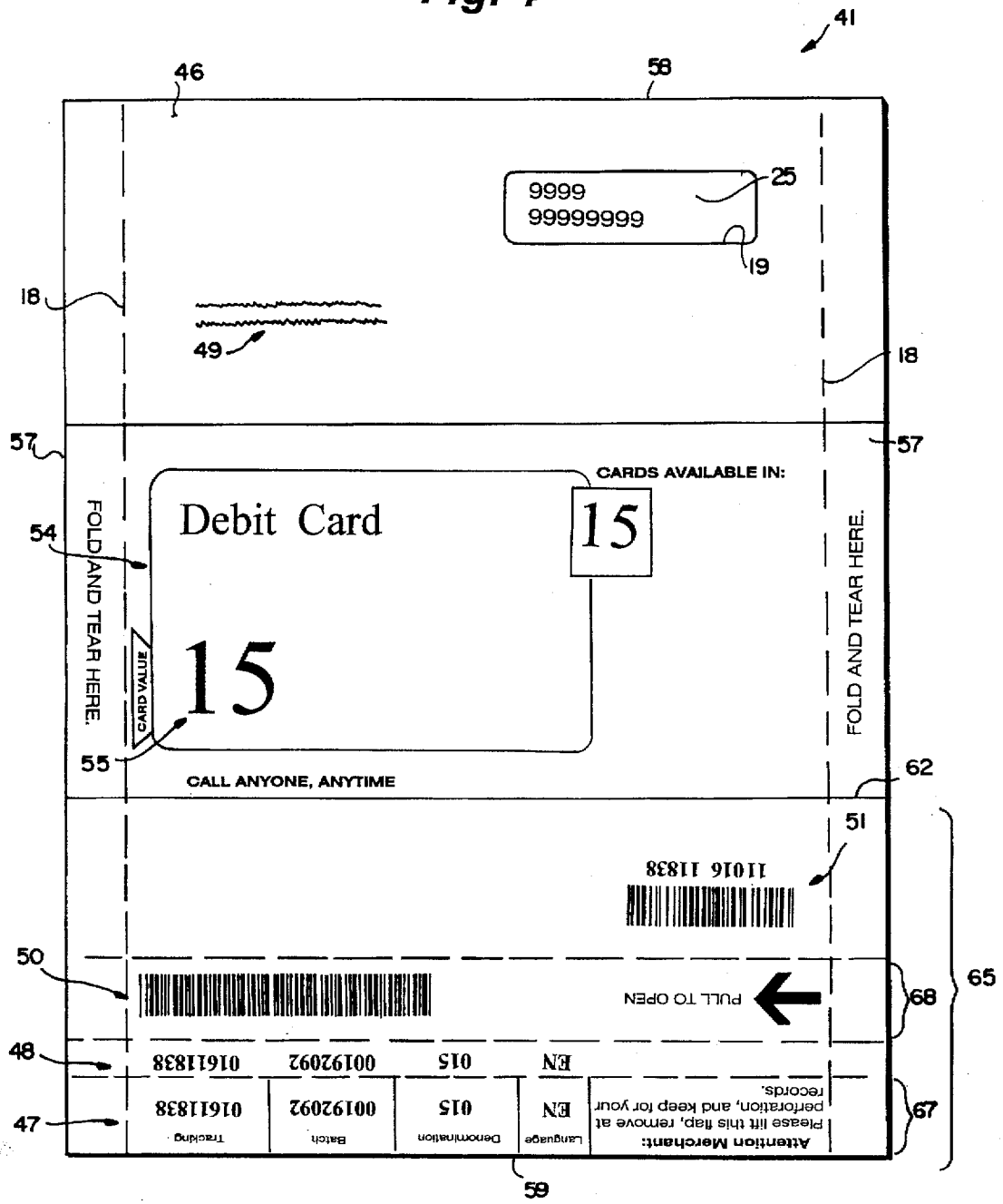
FIG. 4 is a view like that of FIG. 3 only the opposite face of the sheet with attached card before formation of the package assembly.

In addition to the second face 32, the sheet 41 also has a first face 46 (see FIG. 4) which is a face on which typically the variable indicia will be formed, such as the lines of variable indicia 47, 48 illustrated in FIG. 4. Of course, non-variable indicia may also be applied thereto as indicated schematically at 49 in FIG. 4. Also, various machine readable indicia 50, 51, may be provided at various portions thereof. Note that the indicia lines 47, 48 are identical, however, and at least a part of the indicia 47, 48 is typically identical to the machine readable indicia 50, 51 (the indicia 50, 51 typically being identical too).

Particularly where telephone debit cards are to be included in the package 10 according to the invention, a representation/simulation of the first face 53 (see FIG. 3) of the card 24 is provided on the first face 46, as illustrated generally by reference arrow 54 in FIG. 4. The simulation 54 also includes the value of the card 24, for example as indicated by the value indicia 55 (e.g. 15 units, such as long distance minutes) corresponding to the actual unit indicia 56 (see FIG. 3) on the actual card 24.

The sheet 41 includes side edges 57, and end edges 58, 59. The free end edge 59 defines the end of one of the panels of the sheet 41. Typically the sheet 41 will have exactly three panels, although it can be constructed from more than three panels, and the panels can be connected together in a number of different ways depending upon how they are to be folded (e.g. C-folded, Z-folded, etc.). For the embodiment described hereafter it will be assumed that exactly three panels are provided and that the panels are C-folded to form the package 10.

FIGS. 3 and 4 show the sheet 41 with score lines or fold lines 61, 62, the first panel being 63 (see FIG. 3) being formed between the edge 58 and the fold line 61, the second panel 64 between the fold lines 61, 62 and the third panel 65 between the fold line 62 and the transverse edge 59. The pieces of transfer tape 35, 37 are on the third panel 65 second face 32, essentially parallel to the transverse edge 59.

To facilitate tracking and easy opening, a third panel 65 is formed into a tracking strip 67 and an opening-facilitating strip 68. The tracking strip 67 is formed by a first line of weakness 69 parallel to the edge 59 and on the opposite side of the transfer tape 35 from the edge 59. The opening-facilitating strip 68 is formed by the second line of weakness (perforation) 70 parallel to the line 69, and third line of weakness 71, also parallel thereto, the transfer tape 37 (which for the strip 68 typically merely acts as a reinforcing strip, and not for other purposes) disposed between the lines 71 and substantially parallel thereto. In a preferred embodiment the package 10 is further formed by an adhesive pattern (e.g. strip) 72 (see FIG. 3) disposed between the lines of weakness 69, 70 which holds the second face 32 of the third panel 65 to the first face 46 of the first panel 63 when the sheet/form 41 is C-folded about the lines 61, 62, the adhesive 72 being remote from the cutout 19.

As earlier indicated, FIG. 5 indicates the final package 10 according to the invention. The side edges of the package 10 are sealed by the adhesive patterns 31, which connect the second faces (32) of the first and second panels 63, 64 together and the first face (46) of the first panel 63 to the second face 32 of the third panel 65, after C-folding. In this configuration the second face 32 of the panel 65 covers the cutout 19 while the second panel 64 covers the first face 53 of the card 24, so that the card 24 is completely hidden within the package 10.

To track the package 10, all that one need do is separate the tracking strip about the line of weakness 69 since there is no adhesive holding the tracking strip 67 to the final package 10. Once the tracking strip 67 has been detached, however—as illustrated in FIG. 6—the release strip (tape) portion 75 of the transfer tape 35 may be removed (the removal being initiated in the illustration of FIG. 6) exposing the adhesive portion 76 of the transfer tape 35. The adhesive 76—which is pressure sensitive adhesive, but may be repositional, removable, or permanent adhesive—is then applied to a surface, such as a page of a logbook, or the like. A merchant can call in information relating to the indicia 47 on the strip 67 after the time of sale so as to activate the debit card 24 within the package 10. The tracking strip 67 may be removed without opening the package 10. When the package 10 is opened by the ultimate consumer, the ultimate consumer uses the package opening-facilitating strip 68. Since the strip 68 has the reinforcing strip 37 on the back thereof, it is not adhesively secured itself to the rest of the package, and can be readily separated along the lines of weakness 70, 71 by pulling in the direction of the arrow 77 illustrated in FIG. 5. Because of the provision of the reinforcing tape 37, the strip 68 will readily tear only along the lines 70, 71, otherwise retaining its integrity. This removal of the strip 68 then facilitate the easy opening of the package 10.

While the strip 68 typically does not have another use, under certain circumstances it can be used for other purposes. In that case the release material portion of the transfer tape 37—shown at 79 in FIG. 3—may be removed, exposing the adhesive 80 which can then be applied to another surface. Since the machine readable indicia 50 is thereon, this may also be used for other purposes such as tracking, inventory or the like, either by the merchant or ultimate purchaser.

It will thus be seen that according to the present invention a simple yet effective package assembly for cards, such as credit cards, ID cards or particularly telephone debit cards, has been provided, as well as an effective manner of production thereof utilizing only conventional equipment. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A card package assembly comprising:

a sheet of material having first and second side edges, first, second and third panels, said second panel immediately adjacent said first panel and said second panel at least as large as said first panel, and said sheet and each of said panels thereof having first and second faces;

said first panel having a cutout therein;

card-holding adhesive on said first panel second face adjacent said cutout;

a card of material stiffer than said sheet of material, and having first and second faces, with identifying indicia on said second face;

said card overlying said cutout and connected to said card-holding adhesive so that said identifying indicia is visible through said cutout; and adhesive patterns disposed adjacent said first and second side edges for holding said first second and third panels together with said second panel covering said card first face, and said third panel covering said cutout.

2. A card package assembly as recited in claim 1 wherein said sheet has third and fourth edges perpendicular to said first and second side edges, said third edge defining part of said third panel; and wherein said third panel includes a first line of weakness parallel to and spaced from said third edge to define a tracking flap in said third panel; and further comprising tracking indicia imaged on said first face of said third panel at said tracking flap.

3. A card package assembly as recited in claim 2 wherein said card comprises a debit phone card, and wherein indicia on the second panel first face comprises a simulation of the first face of the card, including the value of the card within the package.

4. A card package assembly as recited in claim 2 further comprising a transverse adhesive pattern adjacent said first line of weakness on said third panel second face, connecting said third panel second face to said second panel first face remote from said cutout.

5. A card package assembly as recited in claim 4 further comprising a second line of weakness in said third panel parallel to said first line of weakness and on the opposite side of said transverse adhesive pattern from said first line of weakness, and a third line of weakness in said third panel parallel to said second line of weakness and on the opposite side thereof from said transverse adhesive pattern, said second and third lines of weakness forming an opening-facilitating strip therebetween.

6. A card package assembly as recited in claim 2 further comprising transfer tape disposed on said second face of said tracking flap.

7. A card package assembly as recited in claim 6 further comprising a transverse adhesive pattern adjacent said first line of weakness on said third panel second face, connecting said third panel second face to said second panel first face remote from said cutout.

8. A card package assembly as recited in claim 7 further comprising a second line of weakness in said third panel parallel to said first line of weakness and on the opposite side of said transverse adhesive pattern from said first line of weakness, and a third line of weakness in said third panel parallel to said second line of weakness and on the opposite side thereof from said transverse adhesive pattern, said second and third lines of weakness forming an opening-facilitating strip therebetween.

9. A card package assembly as recited in claim 8 further comprising a piece of reinforcing material on said second face of said third panel at said opening-facilitating strip to reinforce said opening-facilitating strip.

10. A card package assembly as recited in claim 9 wherein said reinforcing material comprises a second piece of transfer tape.

11. A card package assembly as recited in claim 8 further comprising machine readable indicia on said first face of said opening-facilitating strip, and the same machine readable indicia imaged on a portion of said first face of said third panel on the opposite side of said opening-facilitating strip from said transverse adhesive pattern.

12. A card package assembly as recited in claim 1 wherein said card comprises a debit phone card, and wherein indicia on the second panel first face comprises a simulation of the first face of the card, including the value of the card within the package.

13. A card package assembly comprising:

a sheet of material having first and second side edges, third and fourth transverse edges perpendicular to said side edges, first, second and third panels, said second panel immediately adjacent said first panel and said second panel at least as large as said first panel, said third edge defining part of said third panel; and said sheet said sheet and each of said panels thereof having first and second faces;

a card of material stiffer than said sheet of material, and having first and second faces, with identifying indicia on at least said second face;

said card operatively connected to one of said panels;

longitudinal adhesive patterns disposed adjacent said first and second side edges for holding said first, second and third panels together with said panels covering said card first and second faces;

wherein said third panel includes a first line of weakness parallel to and spaced from said third edge to define a tracking flap in said third panel; and said tracking indicia imaged on said first face of said third panel at said tracking flap.

14. A card package assembly as recited in claim 13 further comprising transfer tape disposed on said second face of said tracking flap.

15. A card package assembly as recited in claim 14 further comprising a transverse adhesive pattern adjacent said first line of weakness in said third panel second face, connecting said third panel second face to said second panel first face.

16. A card package assembly as recited in claim 14 wherein said card comprises a debit phone card, and wherein indicia on the second panel first face comprises a simulation of the first face of the card, including the value of the card within the package.

17. A card package assembly as recited in claim 15 further comprising a second line of weakness in said third panel parallel to said first line of weakness and on the opposite side of said transverse adhesive pattern from said first line of weakness, and a third line of weakness in said third panel parallel to said second line of weakness and on the opposite side thereof from said transverse adhesive pattern, said second and third lines of weakness forming an opening-facilitating strip therebetween.

18. A card package assembly as recited in claim 17 further comprising a piece of reinforcing material on said second face of said third panel at said opening-facilitating strip to reinforce said opening-facilitating strip.

19. A card package assembly as recited in claim 13 wherein said card comprises a debit phone card, and wherein indicia on the second panel first face comprises a simulation of the first face of the card, including the value of the card within the package.

20. A card package assembly as recited in claim 13 further comprising a transverse adhesive pattern adjacent said first line of weakness in said third panel second face, connecting said third panel second face to said second panel first face.

* * * * *